United States Patent [19]

Kotas

[11] 4,275,778

[45] Jun. 30, 1981

[54] LOG SPLITTER

[75] Inventor: John A. Kotas, Chicago Heights, Ill.

[73] Assignee: Desa Industries, Inc., Park Forest, Ill.

[21] Appl. No.: 66,083

[22] Filed: Aug. 13, 1979

[51] Int. Cl.[3] ..... B27L 7/00

[52] U.S. Cl. ..... 144/193 A; 144/193 E; 254/93 H

[58] Field of Search ..... 254/93 H, 93 HP, 104; 60/428, 477, 479, 481, 486; 144/193 R, 193 A, 193 C, 193 D, 193 E

[56] References Cited

U.S. PATENT DOCUMENTS

| | | | |
|---|---|---|---|
| 2,548,902 | 4/1951 | Mueller . | |
| 2,548,903 | 4/1951 | Mueller . | |
| 2,654,568 | 10/1953 | Pine | 254/93 H |
| 2,659,307 | 11/1953 | Framhein | 60/479 X |
| 2,664,073 | 12/1953 | Pine | 254/93 H |
| 3,242,955 | 3/1966 | Hellstrom | 144/193 A |
| 3,640,323 | 2/1972 | Helle | 144/193 A |
| 3,982,572 | 9/1976 | Kortendick | 254/104 X |
| 4,102,373 | 7/1978 | Winiasz | 254/104 X |
| 4,103,724 | 8/1978 | Braid | 144/193 A |

FOREIGN PATENT DOCUMENTS

| | | | |
|---|---|---|---|
| 568158 | 3/1977 | Switzerland | 254/93 H |

*Primary Examiner*—W. D. Bray

[57] ABSTRACT

A log splitting apparatus includes a horizontal beam, a hydraulic ram mounted at one end of the beam, and a wedge secured to the other end of the beam. A log placed between the ram and the wedge is split by extending the ram. The wedge is formed by a simple and inexpensive yet sturdy construction which includes a vertical center plate, a pair of wedge plates which are secured to and extend laterally away from the center plate, and gusset plates which extend perpendicularly to the center plate and reinforce the wedge plates. The ram is operable by two operating handles—one for high speed operation and one for high power operation. The handles can be operated separately or simultaneously to provide three operating speeds.

9 Claims, 11 Drawing Figures

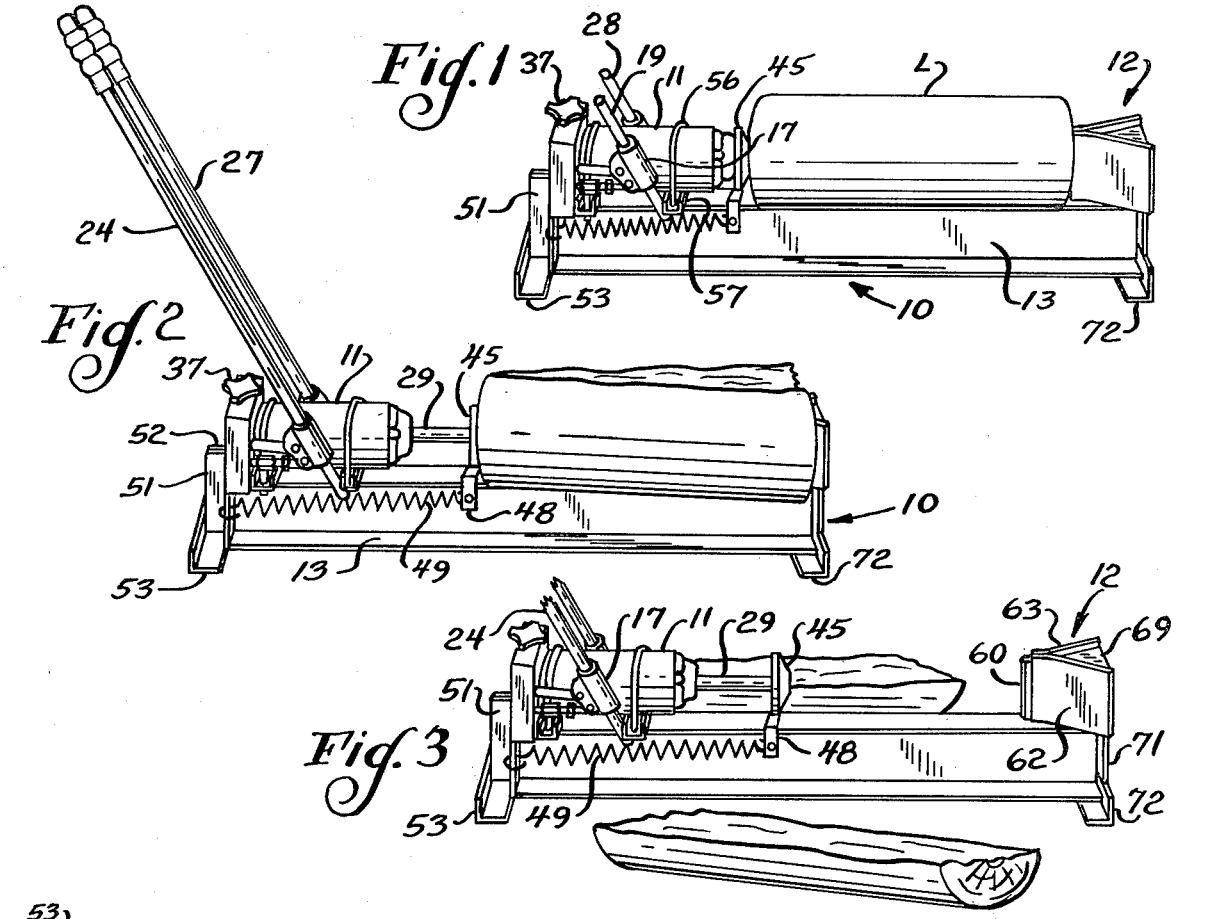
Fig. 1
Fig. 2
Fig. 3
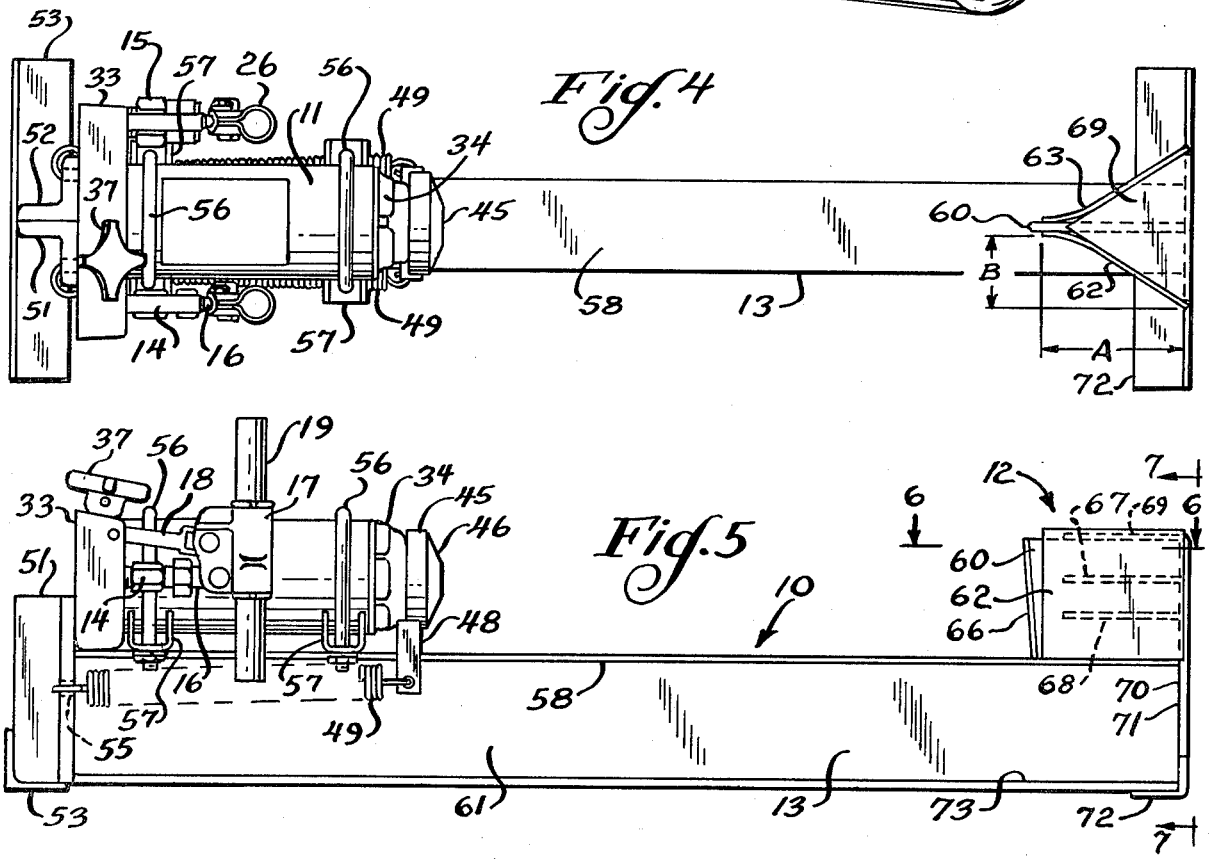
Fig. 4
Fig. 5

LOG SPLITTER

BACKGROUND AND SUMMARY

The invention relates to log splitters, and, more particularly, to a log splitter which utilizes a short-stroke automotive-type hydraulic jack and wide wedge.

Power log splitters have conventionally used a relatively long-stroke hydraulic piston which drives the log through a slim, elongated wedge to split the log its full length. It would be advantageous to use an automotive-type jack instead of longer hydraulic cylinders since such jacks are available from a number of sources at relatively low prices and are capable of exerting substantial force, e.g., 8 tons. However, such a jack has a relatively short stroke, conventionally six inches, which limits the length of logs which can be split with a conventional wedge.

We are aware of one log splitter which uses an automotive-type jack and a relatively wide wedge for splitting logs up to 29 inches long. The wedge is slidably mounted above the jack on a pair of vertical tubes, and the log is placed between the tubes and forced upwardly against the wedge. However, the wedge is rather complex in design, and the log splitter is relatively expensive.

The inventive log splitter utilizes a wedge which is much simpler in construction and therefore inexpensive. Even though the wedge is simple, it is strong and durable. The shape of the wedge enables logs to be split which are much longer than the stroke of the hydraulic power pack, and the wedge can split a number of different types of wood. The log splitter rests horizontally on the ground, making it easier to place and support the log on the log splitter.

The hydraulic power pack is similar to an automotive jack but is provided with a pair of operating or pumping cylinders of different diameters for extending the ram at different speeds. Each pumping cylinder is operable by a separate handle. One of the pumping cylinders extends the ram at a relatively high speed, and the other pumping cylinder extends the ram at a slower speed but with more power. Both handles can be operated simultaneously to extend the ram at a third, higher speed.

DESCRIPTION OF THE DRAWING

The invention will be explained in conjunction with an illustrative embodiment shown in the accompanying drawing, in which—

FIG. 1 is a perspective view of a log splitter formed in accordance with the invention with a log in position to be split;

FIG. 2 is a perspective view similar to FIG. 1 showing the log being split;

FIG. 3 is a perspective view similar to FIGS. 1 and 2 showing the log fully split;

FIG. 4 is a top plan view of the log splitter;

FIG. 5 is a side elevational view of the log splitter;

DESCRIPTION OF SPECIFIC EMBODIMENT

The numeral 10 designates generally a log splitter which includes a hydraulic power pack 11 for forcing a log against a wedge assembly 12. The power pack is mounted on the left end of an I beam 13, and the wedge assembly is mounted on the right end of the I beam.

The power pack is similar to an automotive-type jack. The power pack is rated at ten tons capacity and is designed to operate in a horizontal position.

Figure 8:
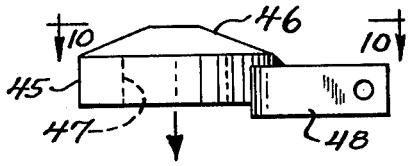
FIG. 8 is a top plan view, partially broken away, of the hydraulic power pack.
Figure 8:
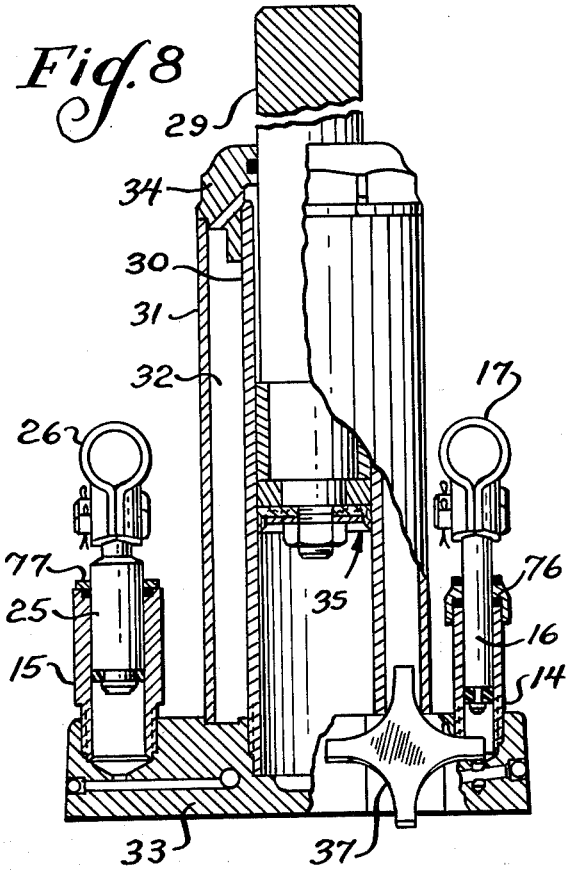
Figure 9:
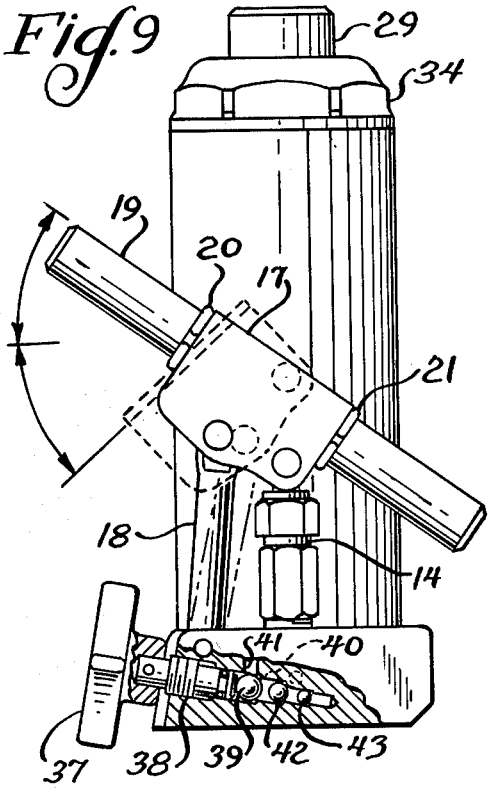
FIG. 9 is a side elevational view of the power pack, partially broken away, showing the ram in its retracted position and the ram pad being inserted on the ram.
Figure 11:
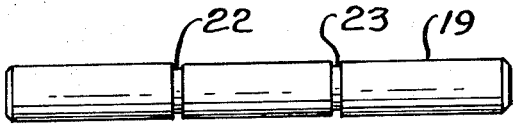
FIG. 11 shows one of the operating rods for the hydraulic pumps.

Unlike conventional automotive jacks, the pack 11 includes a pair of pumping cylinders 14 and 15 of different diameters (see particularly FIG. 8). A pumping piston 16 is reciprocably mounted in the cylinder 14, and a sleeve 17 is pivotally connected to the upper end of the piston and to a link 18 (FIG. 9). A rod 19 extends through the sleeve and is maintained therein by a pair of retaining rings 20 and 21 which fit into grooves 22 and 23 (FIG. 11) in the rod. A tubular handle 24 (FIG. 2) fits over the upper end of the rod, and when the handle is moved back and forth, the piston 16 is reciprocated within the cylinder 14.

A pumping piston 25 (FIG. 8) is similarly mounted in the cylinder 15 and connected to sleeve 26. The piston 25 is reciprocated by a handle 27 (FIG. 2) which fits over a rod 28 (FIG. 1) extending through the sleeve 26.

Referring again to FIG. 8, a ram 29 is reciprocably mounted within a cylinder 30. The cylindrical outer wall 31 of the pack is spaced radially outwardly from the cylinder to form a fluid reservoir 32. The outer wall 31 and the cylinder 30 are mounted in the base 33 of the pack, and end cap 34 joins the other end of the outer wall and cylinder. A conventional sealing assembly 35 on the inner end of the ram sealingly engages the cylinder 30.

The two pumping cylinders 14 and 15 are connected to the fluid reservoir and to the ram cylinder 30 in the conventional manner by check valves so that when a pumping piston is retracted, i.e., moved away from the base of the pack, the piston draws hydraulic fluid from the reservoir into the pumping cylinder. When the pumping piston is moved toward the base, hydraulic fluid is forced from the pumping cylinder into the ram cylinder 30 to extend the ram 29.

The pressure in the ram cylinder 30 is relieved by a release knob 37 (FIG. 9) to permit the ram to retract. The release knob is mounted on a threaded stem 38 which holds a ball check valve 39 against a valve seat in the base of the pack. When the stem is unscrewed by the knob, the ball valve 39 can move away from its seat to permit hydraulic fluid to flow from the ram cylinder 30 through a port 40 to the fluid reservoir through a port 41. The ball check valves 42 and 43 are associated with the pumping cylinders 16 and 15, respectively.

Figure 10:
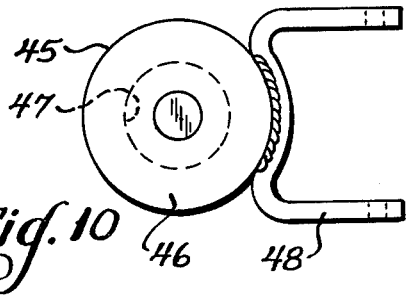
FIG. 10 is an end view of the ram pad taken along the line 10—10 of FIG. 9.

A ram pad 45 (FIGS. 9 and 10) having a frusto-conical end 46 is mounted on the outer end of the ram. The ram pad has a cylindrical recess 47 which is sized to snugly receive the ram. A generally U-shaped bracket 48 is welded to the ram pad and extends below the top of the I beam 13 (see FIGS. 2 and 5). A pair of return springs 49 are connected to the bracket and return the ram to its retracted position illustrated in FIG. 5 when the release knob is opened.

Movement of the pack away from the wedge is pre-ented by a pair of L-shaped bracing plates 51 and 52 ;ee FIGS. 4 and 5) which are welded to the left end of ıe I beam. The lower ends of the bracking plates are ′elded to a generally L-shaped foot plate 53. Each of ıe bracing plates is provided with an opening 55 (FIG. ) for attaching the return springs 49 to the bracing lates.

The pack is secured to the I beam by a pair of U bolts 6. Each U bolt extends through a channel-shaped sad-le 57 which is welded to the top plate 58 of the I beam. 'he top of each saddle is provided with a concave ;cess which cradles the cylinder outer wall of the ack.

The wedge assembly 12 includes a vertically extend-ıg center plate 60 (FIGS. 4–7) which is aligned with ıe web 61 of the I beam. The right edge of the center late is aligned with the right end of the I beam, and the ottom edge of the center plate is welded to the top late 58 of the I beam.

Figure 6:
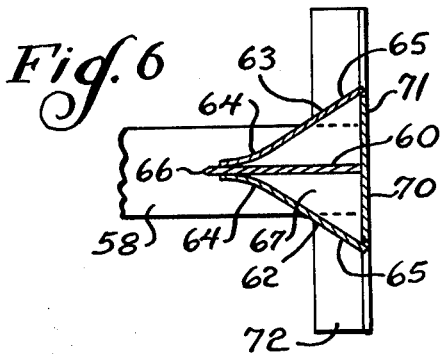
FIG. 6 is a fragmentary sectional view taken along the line 6—6 of FIG. 5.
Figure 7:
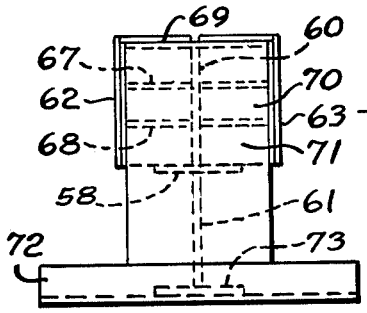
FIG. 7 is an end elevational view taken along the line 7—7 of FIG. 5.

A pair of wedge plates 62 and 63 are welded to both ıe center plate and to the top plate of the I beam. .eferring to FIG. 6, each of the wedge plates includes ı arcuate or curved inner portion 64 and a substantially :raight outer portion 65. The inner edge of each of the ′edges plates is spaced to the right of the left edge of ıe center plate 60 so that the narrow edge of the wedge ssembly is provided by only a single thickness of metal. 'urther, the left or cutting edge 66 of the center plate 60 sharpened and slants toward the base of the log split-:r as it proceeds away from the I beam (see FIG. 5) so ıat the upper portion of the cutting edge contacts the ›g first.

Each of the wedge plates are reinforced by a pair of orizontally extending triangular gusset plates 67 and 8 (FIGS. 5–7) which are welded to the center plate 60 ıd to the straight portions 65 of the wedge plates. The pper edges of the wedge plates are reinforced by a iangularly shaped gusset plate 69 (FIG. 4) which is art of an L-shaped cover 70. The cover also includes a at end plate 71 which abuts the right end of the I beam ıd is welded thereto. The converging edges of the usset plate 69 are welded to the flat portions of the 'edge plates 62 and 63, the center of the gusset plate is 'elded to the upper edge of the center plate 60, and the ;rtical end plate 71 is welded to the right edge of the ;nter plate 60 and to the right end of the I beam.

An L-shaped foot plate 72 is welded to the right end ' the I beam and to the bottom plate 73 of the I beam. he lower edge of the end plate 71 can be welded to the ›per edge of the foot plate.

In one specific embodiment of the invention, the ;rtically extending center plate 60 and the wedge ates were formed from 7 gauge (0.172 inch) sheet ock. The curved portions of the wedge plates 62 and 3 had a radius of four inches, the inner edges of the 'edge plates were substantially tangent to the center ate 60, and the flat portions of the wedge plate ex-nded at an angle of about 31° with respect to the ;nter plate 60. The horizontal longitudinal dimension ' each of the wedge plates between the inner edge of ıe curved portion and the end plate 71 (dimension A in IG. 4) was 4.65 inches, and the horizontal transverse mension between the inner edge of the curved portion ıd the outer edge of the straight portion (dimension B FIG. 4) was 2.41 inches. The vertical dimension of e wedge plates was 4.00 inches. The horizontal lower lge of the center plate 60 was 4.75 inches, the horizontal upper edge was 5.00 inches, and the vertical dimension or height was 3.75 inches. The other parts of the wedge assembly were also formed from readily available sheet material, preferably 10 gauge (0.134 inch). The I beam was an ASTM A36 structural H.R. I beam having a width of 2.66 inches, a height of 4 inches, and a weight of 7.7 pounds per foot.

We have found that this shape of wedge works well with a variety of different wood even though the stroke of the ram is relatively short. For example, oak is relatiely easy to split, and a wider wedge, i.e., one that diverges laterally outwardly more rapidly, could be used for oak. However, elm is harder to split, and wide wedges often do not provide complete splitting with a short stroke ram. The relatively narrow wedge of the preferred embodiment (approximately 5 inches at the back of the wedge) provides complete splitting for both oak and elm.

In use the log splitter is supported horizontally on the ground by the two foot plates 53 and 72. The foot plates extend laterally outwardly from the I beam and stabilize the log splitter. A log L is positioned on the top plate 58 of the I beam between the retracted ram and the wedge. The ram can be extended at two different speeds by pumping either handle 24 or handle 27, or the ram can be extended at a faster speed by pumping both handles simultaneously. Referring again to FIG. 8, the pumping cylinder 15 has a larger diameter than the pumping cylinder 14, and the piston 25 will pump a larger volume of fluid into the ram cylinder on each stroke. The piston 25 will therefore extend the ram at a faster speed than the piston 16. However, because of its smaller area, the piston 16 can exert more force on the ram. Thus, piston 25 can be used for fast operation and the piston 16 can be used for slower yet more powerful operation. If both pistons are operated simultaneously, the ram will be extended at an even faster rate.

In one specific embodiment, the piston 16 had a diameter of 0.50 inch and a pump stroke of 1.3 inch. The piston 25 had a diameter of 0.87 inch and a pump stroke of 1.3 inch. The large piston 25 could extend the ram 6 inches with 20 strokes, and the piston 16 could extend the ram 6 inches with 65 strokes.

If desired, the pack can be provided with a safety relief valve for relieving the hydraulic pressure if it becomes excessive. This protects the pack from being overloaded beyond its 10 ton capacity.

FIG. 2 illustrates the log being split by the wedge as the log is pushed toward the wedge by the ram. The ram pad 45 engages the log as the ram extends, thr frusto-conical surface 46 of the ram assures good contact between the ram pad and the log even if the end of the log was cut unevenly The shape of the wedge will ordinarily split the log along its entire length even though the stroke of the ram is only 6 inches. The split halves of the log will fall to each side as illustrated in FIG. 3, and the ram can be retracted merely by turning the release knob 37.

On occasion a log might not be completely split after the ram has been fully extended. In that event the ram is retracted, a block of wood or the like is inserted between the ram and the log, and the ram is extended again. Since the log is supported horizontally by the I beam, the log ordinarily does not have to be held while the ram is retracted and the block is inserted.

Referring to FIGS. 1 and 5, the rods 19 and 28 which mount the pack handles extend downwardly from the sleeves 17 and 26 of the two hydraulic pumps. The lower end of each rod is engageable with the saddle 57 which supports the pack to prevent the pumping pistons from moving past the seals 76 and 77 (FIG. 8) in the pumping cylinders.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A log splitting apparatus comprising a horizontally extending elongated beam having first and second ends, a hydraulic power pack mounted on the first end of the beam, a wedge assembly mounted on the second end of the beam, the wedge assembly including a vertically extending center plate extending parallel to the longitudinal axis of the beam and aligned with the power pack and secured to the second end of the beam, a pair of wedge plates, each of the wedge plates having a curved portion secured to the center plate and a substantially flat portion extending from the curved portion at an acute angle with respect to the center plate, and a triangularly shaped horizontally extending gusset plate on top of the center plate and extending between and engaging the flat portions of the wedge plates for reinforcing the wedge plates.

2. The apparatus of claim 1 including a vertically extending cover plate extending over the second end of the beam and the center plate and secured thereto.

3. The apparatus of claim 2 in which said gusset plate is integral with the cover plate and extends toward the first end of the beam.

4. The apparatus of claim 1 including a ram pad on said power pack and a return spring connected to the ram pad and to the beam.

5. The apparatus of claim 4 in which the ram pad has a generally frusto-conical surface for engaging a log to be split.

6. The apparatus of claim 1 including a pair of stabilizing plates secured to the bottom of the beam at the ends thereof and extending laterally outwardly therefrom.

7. The apparatus of claim 1 in which the center plate extends toward the power pack beyond the curved portions of the wedge plates to provide a cutting edge, the cutting edge being inclined toward the pack.

8. The apparatus of claim 1 in which the power pack includes a ram reciprocally mounted in a ram cylinder, a pair of pumping cylinders, and a pumping piston reciprocably mounted in each of the pumping cylinders for forcing hydraulic fluid into the ram cylinder for extending the ram, each of the pumping pistons having a different diameter whereby each pumping piston extends the ram at a different speed.

9. The apparatus of claim 1 including at least one triangularly shaped reinforcing plate on each side of the center plate, each of said reinforcing plates extending parallel to said gusset plate below the gusset plate and being secured to the center plate and to the flat portion of one of the wedge plates.

* * * * *